US006305336B1

(12) United States Patent
Hara et al.

(10) Patent No.: US 6,305,336 B1
(45) Date of Patent: Oct. 23, 2001

(54) ELECTROMAGNETIC DRIVING DEVICE OF ENGINE VALVE FOR INTERNAL COMBUSTION ENGINE

(75) Inventors: Seinosuke Hara; Katsuhisa Todoroki; Yoshihiko Yamada; Tsutomu Hibi, all of Kanagawa (JP)

(73) Assignee: Unisia Jecs Corporation, Kanagawa (JP)

( * ) Notice: Subject to any disclaimer, the term of this patent is extended or adjusted under 35 U.S.C. 154(b) by 0 days.

(21) Appl. No.: 09/565,493

(22) Filed: May 5, 2000

(30) Foreign Application Priority Data

May 7, 1999 (JP) ..... 11-126811

(51) Int. Cl.[7] ..... F01L 9/04

(52) U.S. Cl. ..... 123/90.11; 123/90.6; 123/90.65; 251/129.01; 251/129.16

(58) Field of Search ..... 123/90.11, 90.15, 123/90.16, 90.17, 90.6, 90.65; 251/129.01, 129.1, 129.15, 129.16

(56) References Cited

U.S. PATENT DOCUMENTS

| | | | | |
|---|---|---|---|---|
| 4,867,111 | * | 9/1989 | Schneider et al. | 123/90.11 |
| 4,942,854 | | 7/1990 | Shirai et al. | 123/90.17 |
| 5,117,213 | | 5/1992 | Kreuter et al. | 335/219 |
| 5,636,601 | | 6/1997 | Moriya et al. | 123/90.11 |
| 6,085,704 | * | 7/2000 | Hara | 123/90.11 |
| 6,202,609 | * | 3/2001 | Metz | 123/90.11 |

FOREIGN PATENT DOCUMENTS

| | | |
|---|---|---|
| 2 058992 A | 4/1981 | (GB) . |
| 56-14817 | 2/1981 | (JP) . |
| 58-167707 | 11/1983 | (JP) . |
| 62-271915 | 11/1987 | (JP) . |
| 1-301903 | 12/1989 | (JP) . |
| 2-34703 | 3/1990 | (JP) . |
| 7-305613 | 11/1995 | (JP) . |
| 8-21220 | 1/1996 | (JP) . |

* cited by examiner

*Primary Examiner*—Weilun Lo
(74) *Attorney, Agent, or Firm*—Sughrue, Mion, Zinn, Macpeak & Seas, PLLC

(57) ABSTRACT

An electromagnetic driving device of engine valve for internal combustion engine comprising an electromagnetic deriving mechanism includes a first and second electromagnets positioned opposite each other, an armature disposed in a gap formed between the electromagnets for moving therebetween, a follower having a first and second followers that are positioned opposite each other is for moving in relation to the armature, a valve associated with the armature for closing and opening an intake or exhaust passage, a first and second cams having gradually varied their profile are pivoted for contacting respective the first and second followers, a spring is disposed between the follower and the cams for urge the first and second cams toward the first and second followers, respectively. Thereby, the armature is prevented from colliding the electromagnet, and the valve capable of seating a valve seat smoothly and gently, so that the valve is possible to indicate an ideal valve lift characteristic at the end period of the valve. Therefore, this invention is possible to prevent noise, wearing and damage caused by the collision between the valve and the valve seat and between the armature and the electromagnet.

19 Claims, 11 Drawing Sheets

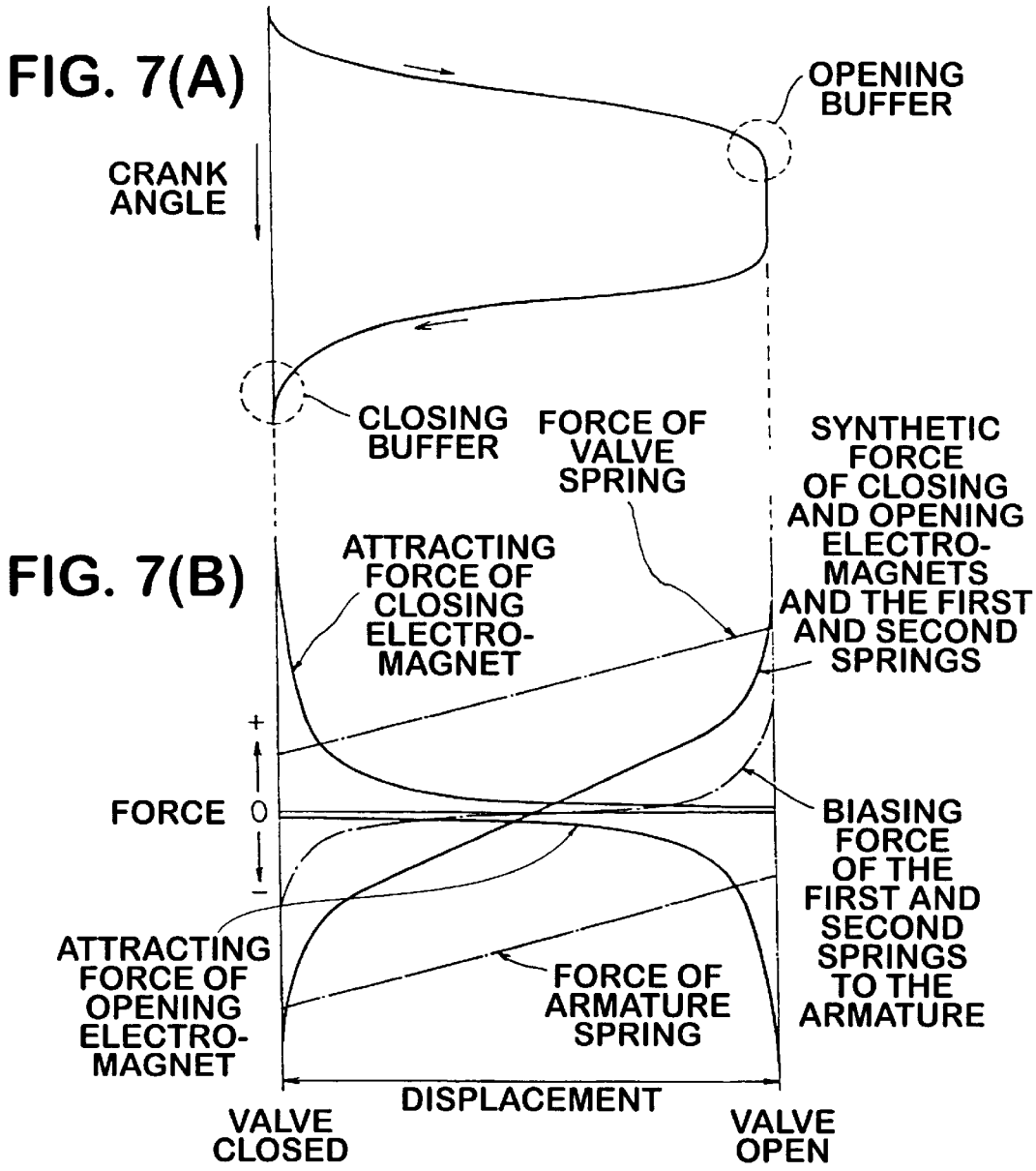
FIG. 7(A)
OPENING BUFFER
CRANK ANGLE
CLOSING BUFFER
FORCE OF VALVE SPRING
SYNTHETIC FORCE OF CLOSING AND OPENING ELECTRO-MAGNETS AND THE FIRST AND SECOND SPRINGS
FIG. 7(B)
ATTRACTING FORCE OF CLOSING ELECTRO-MAGNET
+
FORCE
0
−
BIASING FORCE OF THE FIRST AND SECOND SPRINGS TO THE ARMATURE
ATTRACTING FORCE OF OPENING ELECTRO-MAGNET
FORCE OF ARMATURE SPRING
DISPLACEMENT
VALVE CLOSED
VALVE OPEN

ELECTROMAGNETIC DRIVING DEVICE OF ENGINE VALVE FOR INTERNAL COMBUSTION ENGINE

BACKGROUND OF THE INVENTION

This invention relates to an electromagnetic driving device that operates an engine valve for an internal combustion engine of an automobile. This type of the electromagnetic driving devices have been proposed, for example the prior art disclosed in Japan unexamined publication (Koukai) No.8-21220, in which an intake valve slidably disposed on a cylinder head is operated by a magnetic force. Referring now to FIG. 12, there is an electromagnetic driving device that includes a driving mechanism 103 that controls the opening and closing status of an intake valve 102. The intake valve 102 includes a valve portion 1002*a* that opens and closes an opening of an intake port 104 and a valve stem 102*b* that is integrated with an upper end of the valve portion 102*a*. The electromagnetic driving mechanism 103 comprises an armature 106 that is encased in a casing 105 fixed on the cylinder head 100, is shaped like a plate, and is couple with the upper end of the valve stem 102*b*, and a pair of electromagnets. In particular, a closing-electromagnetic 107 and an opening-electromagnetic 108 are housed in the respective upper and lower portion of the casing 105 and are placed opposite side of the armature 106 for attracting the armature 106 so as to open and close the intake port 104. An armature spring 109 is installed between an upper wall of the casing 105 and an upper surface of the armature 106 and urges the valve 102 to close the opening of the intake port 104. Similarly, a valve spring 110 is interposed between a concave portion 101 of the cylinder head 100 and a lower surface of the armature 106, and urges the valve 102 to close the opening of the intake port 104. Further, each coil of the closing and opening-electromagnets 107, 108 is energized through an amplifier 111 according to a control signal produced by an electronic control unit 112. The electronic control unit 112 produces the control signal that controls a power-supply to the closing and opening-electromagnets 107, 108 based on any of plural detected signals, such as an engine revolution detected by an engine revolution sensor 113 and a temperature of coolant detected by the thermometer 114. Also, a power source designated 115 supplies a power to each coil of the closing and opening-electromagnets 107,108. Thereby, the spring forces of the valve and armature spring 109,110 and the attracting forces of the electromagnetic 107,108 are retained in respective springs 109,110 as a potential energy. With this, the valve 102 is alternatively attracted and released by one of the closing and opening electromagnets 107,108 to open or close the opening of the intake port 104 using that potential energy.

In the prior art, however, the attracting force of the closing and opening-electromagnets 107,108 is larger than the spring forces of the armature and valve spring 109, 110 urging the armature 106 against respective attracting forces, so that the end of the valve portion 102*a* might collide with a valve seat 104*a* of the cylinder head when the valve 102 closes the opening of the intake port, and the armature 106 might collide with the opening-electromagnetic 108 when the valve 102 opens the opening of the intake port. Referring to FIG. 13A, 13B, there is shown the principle of the attracting force for the closing and opening-electromagnets 107, 108. First, FIG. 13B shows the characteristics of the spring force between the attracting force of the electromagnets 107,108 and the spring forces of the armature and valve spring 109,110 when the valve 102 closes the opening of the intake port, the armature 106 is attracted to the closing-electromagnetic 107. Thereby, the valve spring 110 is extended and the armature spring 109 is compressed, so that a spring force of the armature spring 109 is accumulated therein. Next when the valve 102 opens the opening of the intake port, the closing electromagnet is de-energized, and alternatively the opening-electromagnet 108 is energized, thereby the armature 106 is attracted to the opening-electromagnetic 108. Therefore, the armature spring 109 is extended and the valve spring 110 is compressed, so that a spring force of the valve spring 110 is accumulated therein. Namely, respective accumulated forces of the armature and valve spring 109, 110 affects the armature 106 to reduce the speed of the armature 106 approaching the electromagnets 107,108. On the other hand, because the attracting force of the electromagnet is increased indirectly by the second power of a distance between the core of the electromagnets 107*a*, 108*a*, the attracting forces of the electromagnets are suddenly increased when the armature 106 is close to the electromagnets. Therefore, since the accumulated spring forces are not large enough to reduce the increased attracting force of the electromagnetic, the armature 106 is suddenly urged toward the one of the electromagnets 107, 108 when the armature 106 approaches close to one of the electromagnets 107, 108. As seen in FIG. 13A, due to a sudden increased attracting force of the electromagnets 107,108, the valve 102 collides with the valve seat 104*a*, when the valve closes the opening of the intake port, and the armature 106 collides with the opening-electromagnet 108, when the valve 102 opens it. Thereby, such a collision causes not only noise but also might cause wear and a fracture of the armature 106 and the valve seat 104*a*.

Moreover, the prior art requires an arrangement that balances the force between the attracting force of the closing-electromagnet 107 and the armature spring 109, in order to make the valve portion 102*a* urged toward the valve seat 104*a* with an appropriate force. However, since a gap between the armature 106 and the core of the electromagnet 107*a* is varied because of wear of the armature 106, the valve springs 109, 110 and the valve seat 104*a* and a heat expansion of the valve stem 102*b*, thereby the attracting force is also varied from the required value. Thus, the gap will occur between the valve portion 102*a* and the valve seat 104*a*, so that the valve portion 102*a* might not be capable of closing the opening of the intake port 104 tightly and might be covered with foreign matter. If so, the valve also might be melted since the foreign matter prevents dissipating heat therefrom.

Also, method of assembly of the prior art structure of FIG. 12 will be described. At first the valve 102 is inserted in the cylinder head 101 from the opening of the intake port 104*a*. Then, the opening-electromagnet 108 is disposed on the cylinder head 101. Finally, the armature 106 is coupled with the end of the valve stem 102*b* with installing the armature and valve springs 109, 110. Therefore, the prior art requires that assembly has to be performed using on the cylinder head 101, and an accurate arrangement of upper and lower position of the armature 106 with respect to the electromagnets 107, 108. Accordingly, the prior art increases the cost of the manufacturing and manufacturability.

SUMMARY OF THE INVENTION

It is, therefore, an object to the present invention is to provide an improved electromagnetic driving device for a engine valve which is capable of preventing a collision between a valve and a valve seat of a cylinder head, and a collision between an armature and an electromagnet.

Another object of the invention is to provide an improved electromagnetic driving device for an engine valve that can be assemble easily and be installed to the cylinder head.

In order to achieve these and other objects, there is provided an electromagnetic driving device for an engine that comprises an electromagnetic driving mechanism having first and second electromagnets that are placed on opposite sides of an armature, a controller that controls magnetic forces of the electromagnets in accordance with an engine condition for operating a movement of the armature, a follower member, having first and second follower surfaces that are opposite to each other, that is coupled with the armature, a valve that is linked with the armature for closing and opening an intake or exhaust passage, first and second cams having gradually varied profiles that are pivoted for contacting respective first and second follower surfaces, and a spring that urges the first and second cams toward first and second follower surfaces, respectively.

Other and further objects, features and advantages of the present invention will appear more fully from the following description.

BRIEF DESCRIPTION OF THE DRAWING

FIG. 7A is a graph, showing a characteristic of the timing of an intake valve opening and closing of an intake port of a cylinder head.

FIG. 7B is a graph, showing a characteristic of a spring force of respective electromagnets and springs.

DETAILED DESCRIPTION OF THE PREFERRED EMBODIMENT OF THE INVENTION

An electromagnetic driving device for an engine valve, and in particular the electromagnetic driving device applied to an intake valve of internal combustion engine in accordance with preferred embodiments of the present invention, will be described with reference to the Figures.

Figure 1:
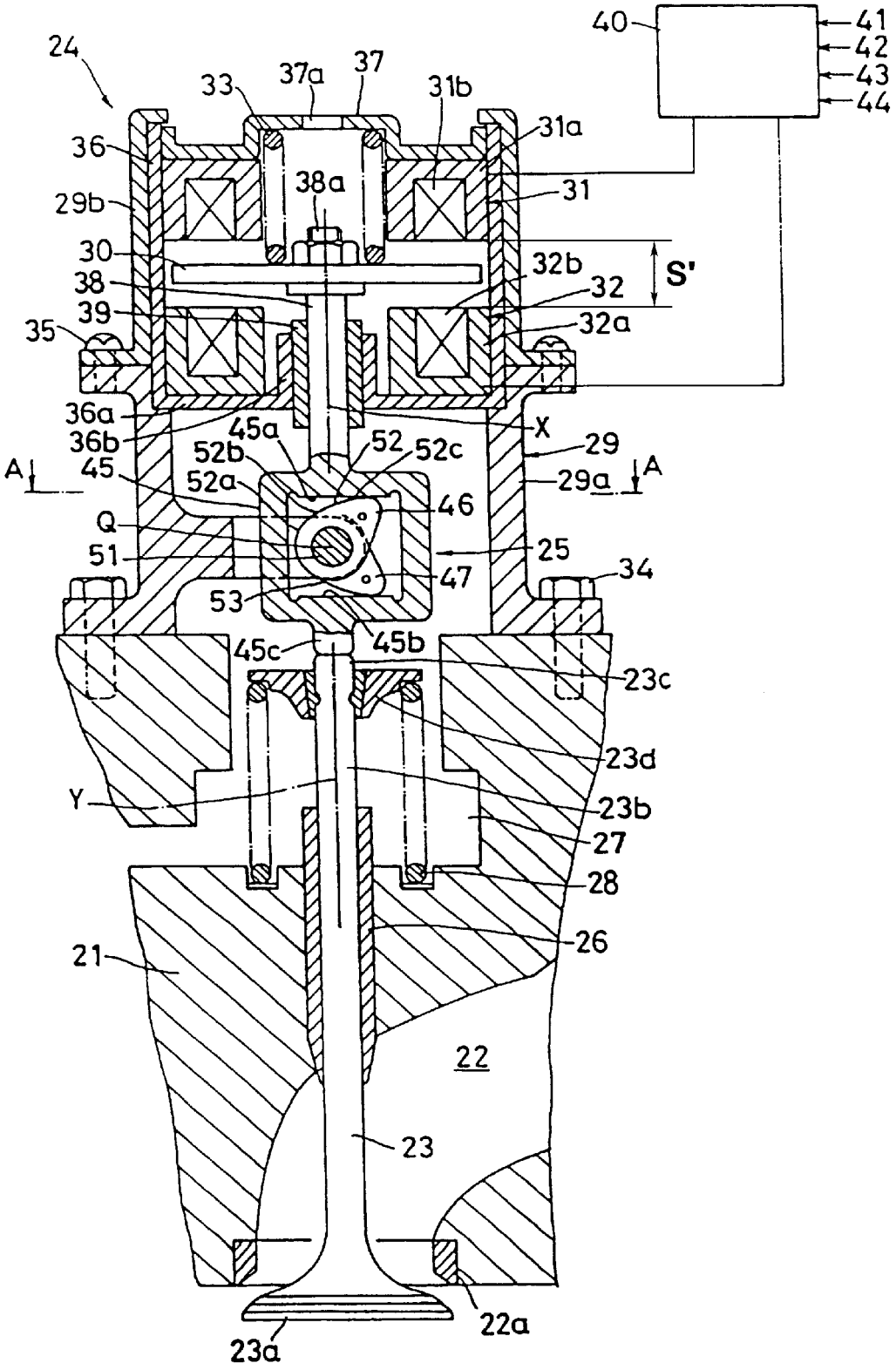
FIG. 1 is a vertical sectional drawing, showing an electromagnetic driving device for an engine valve in accordance with the first embodiment of the present invention.

FIG. 1 is a vertical sectional view of the first embodiment that shows the electromagnetic driving device that includes an intake valve 23 that opens and closes the intake port 22 formed in a cylinder head 21. FIG. 1 also shows an electromagnetic driving mechanism 24 that operates the intake valve 23 in order to open and close the intake port 22 according to an engine condition, and a brake mechanism 25 that is disposed in a linkage between the electromagnetic driving mechanism 24 and the intake valve 23. The intake valve 23, having a valve portion 23*a*, is faced to a combustion chamber, and a valve stem 23*b* is integrated with an upper end of the valve portion 23*a* and is sliderably inserted in a valve guide 26. The intake valve 23 closes the intake port when the valve portion 23*a* seats a circular-shaped valve seat 22*a*. On the other hand, as the valve portion 23*a* is apart from the valve seat 22*a*, the intake valve 23 opens the intake port 22.

The intake valve 23 is also urged to close the intake port 22 by the valve spring 28 that is interposed between a retainer 23*d* fixed at an end of valve stem 23*c* and a concave portion 27 formed in the cylinder head 21.

The electromagnetic driving device 24 includes an armature 30 shapes like a plate, a pair of electromagnets, a closing-electromagnet 31 and a opening-electromagnet 32, are placed opposite side of the armature 30 and are encased in a casing 29 disposed on the cylinder head 21.

The armature 30 is capable of moving within a gap formed between the electromagnets 31, 32, and an armature spring 33 is installed on an upper surface of the armature 30 and urges the armature 30 in an opening direction of intake valve 23.

As shown FIG. 1, the casing 29 having a casing body 29*a* that is fixed on the cylinder head 21 by means of four bolts 34, and is covered with a casing cover 29*b* made of non magnetic material through a plurality of screws 35. A casing holder 36 made of non magnetic material is inserted in an inner circumference of the casing cover 29*b*, and an upper opening of the casing cover 29*b* is covered with a lid 37 made of non-magnetic material. The lid 37 is provided with a closing-electromagnet 31 on an inner surface thereof and an air hole 37*a* at its center portion for establishing an air communication between an inside and outside of the casing cover 29*b*. The opening-electromagnet 32 is fixed on a bottom of the casing holder 36*a* so as to face to the closing-electromagnet 31 affixed to the lid 37.

An upper and lower surface of the armature 30 face the respective closing and opening-electromagnet 32, 33. An upper end of guide rod 38*a* is coupled with a center portion of the armature 30 through a screw, and a lower end of guide rod 38 is integrated with a follower 45 of the brake mechanism 25. The guide rod 38 is slidably inserted in a cylindrical guide 39 so that an axis X of the guide rod 38*a* is coaxial with an axis Y of the intake valve 23.

The closing and opening-electromagnets 31, 32 and provided with fixing cores 31*a*, 32*a* that are formed with a U-shape cross section and are disposed on opposite sides of the armature 30. The electromagnetic coils 31*b*, 32*b* are wound around an inner wall of the fixing cores 31*a*, 32*a* and are energized according to an energized signal or a de-energized signal from an electric control unit 40 for attracting the armature 30 upwardly or downwardly.

The armature spring 33 is interposed between an upper surface of the armature 30 and an under surface of the lid 37, and a spring force of the armature spring 33 is designed so as that the armature 30 is positioned at a midpoint between the electromagnets 31, 32 when both of the electromagnets 31, 32 are de-energized. In that situation, the intake valve 23 is also kept at substantially midpoint between maximum and zero valve lifts.

The electronic control unit 40 alternatively and repeatedly outputs the energized and de-energized signals to the respective closing and opening-electromagnets 31,32. In order to determine the energized and de-energized signals, a crank sensor 41 detecting a rotational degree of the crank, an engine revolution sensor 42 detecting an engine revolution, a thermometer 31 detecting a temperature of the closing-electromagnets 31, and an air flow meter 44 detecting an engine load are provided, and the outputs of these sensors are fed to the electronic control unit 40. A signal indicating a rotational crank degree from the crank sensor 41 is used for bringing opening and closing timing of the intake valve 23 into sync with the rotational timing of the crank shaft. A signal indicating a revolution of the engine from the engine revolution sensor 42, that is, a revolution of crank shaft, is used for calculating permissible attraction time of the electromagnets 31, 32. A signal indicating a temperature of the closing-electromagnet 31 from the thermometer 43 is used for regulating a increasing resistance of the electromagnetic coil 31*b* from the increasing temperature thereof. A signal indicating a load of the engine from the air flow meter 44 is used for controlling the appropriate opening and closing timing of the intake valve 23 according to an engine condition.

Figure 2:
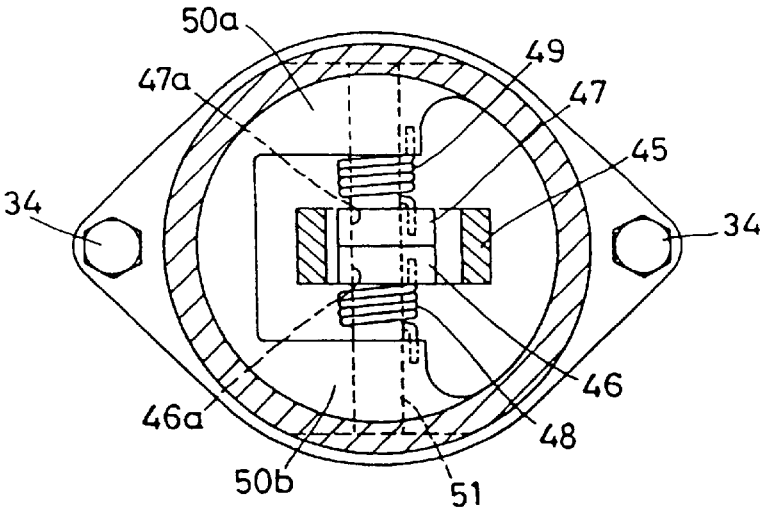
FIG. 2 is a sectional view taken on line A—A of FIG. 1.

As shown in FIG. 1 and FIG. 2, the braking mechanism 25 includes the follower 45 that is integrated with the lower end 38*b* of the guide rod 38, first and second swing cams 46, 47 that are rotatably supported on an inside of the follower 45, and first and second coil springs 48, 49 that urge the first and second swing cams 46, 47 toward respective first and second surfaces 45*a*, 45*b* of the follower 45.

The follower 45 is substantially shaped like a rectangle or a square and comprises an upper and lower portions of the follower 45 that is provided with the respective first and second follower surfaces 45*a*, 45*b* so as to face each other. The lower end of the guide rod 38 is integrated with the upper portion of the follower 45, and a protrusion 45*c* formed on the lower portion of the follower 45 is contacted with the stem end 23*c* of the valve stem 23*b*.

Figure 3A:
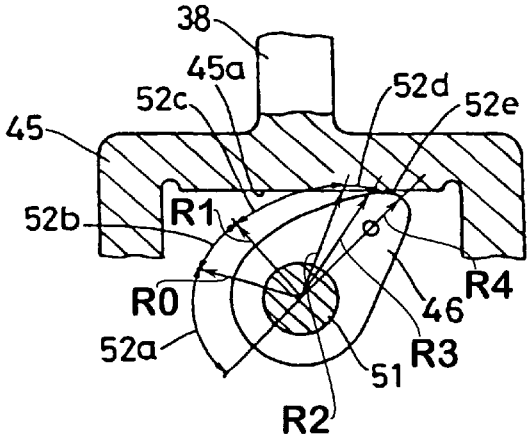
FIG. 3A is an enlarged drawing, showing a first cam of the first embodiment of the present invention.
Figure 3B:
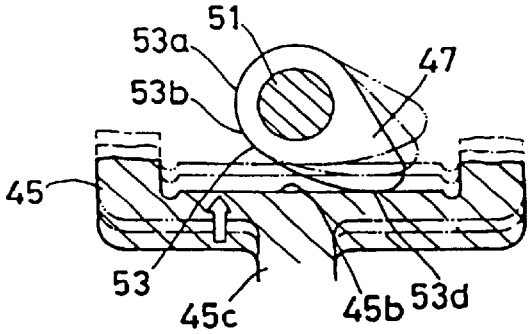
FIG. 3B is an enlarged drawing, showing a second cam of the first embodiment of the present invention.
Figure 4:
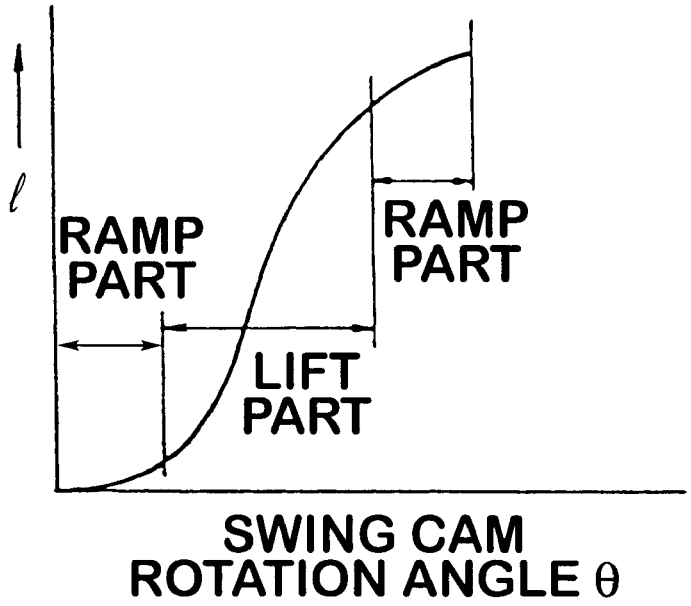
FIG. 4 is a graph representation, showing a characteristic of a rotational degree of a cam with respect to a vertical stroke of an armature.
Figure 5:
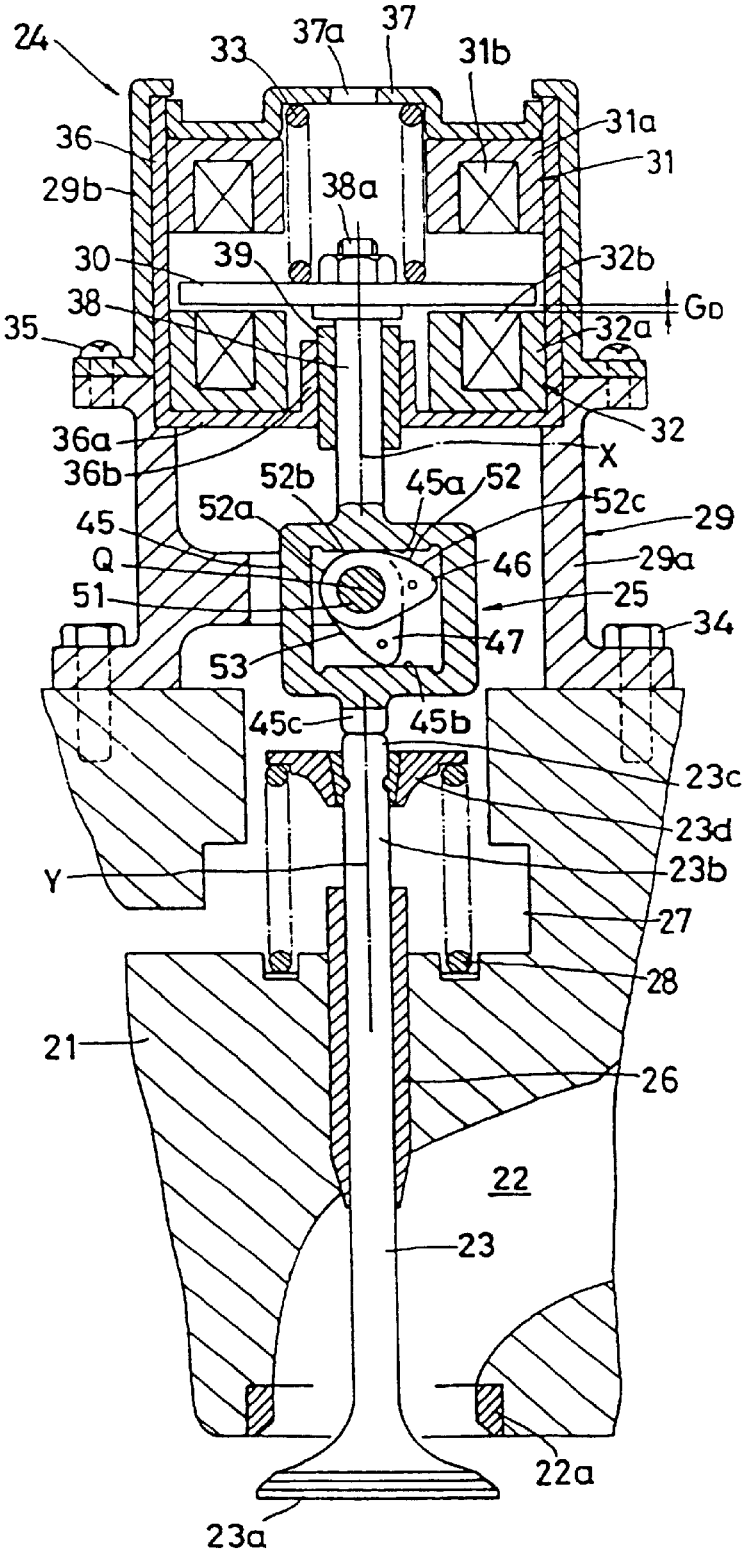
FIG. 5 is a vertical sectional drawing, showing a valve open state of the first embodiment of the present invention.
Figure 6:
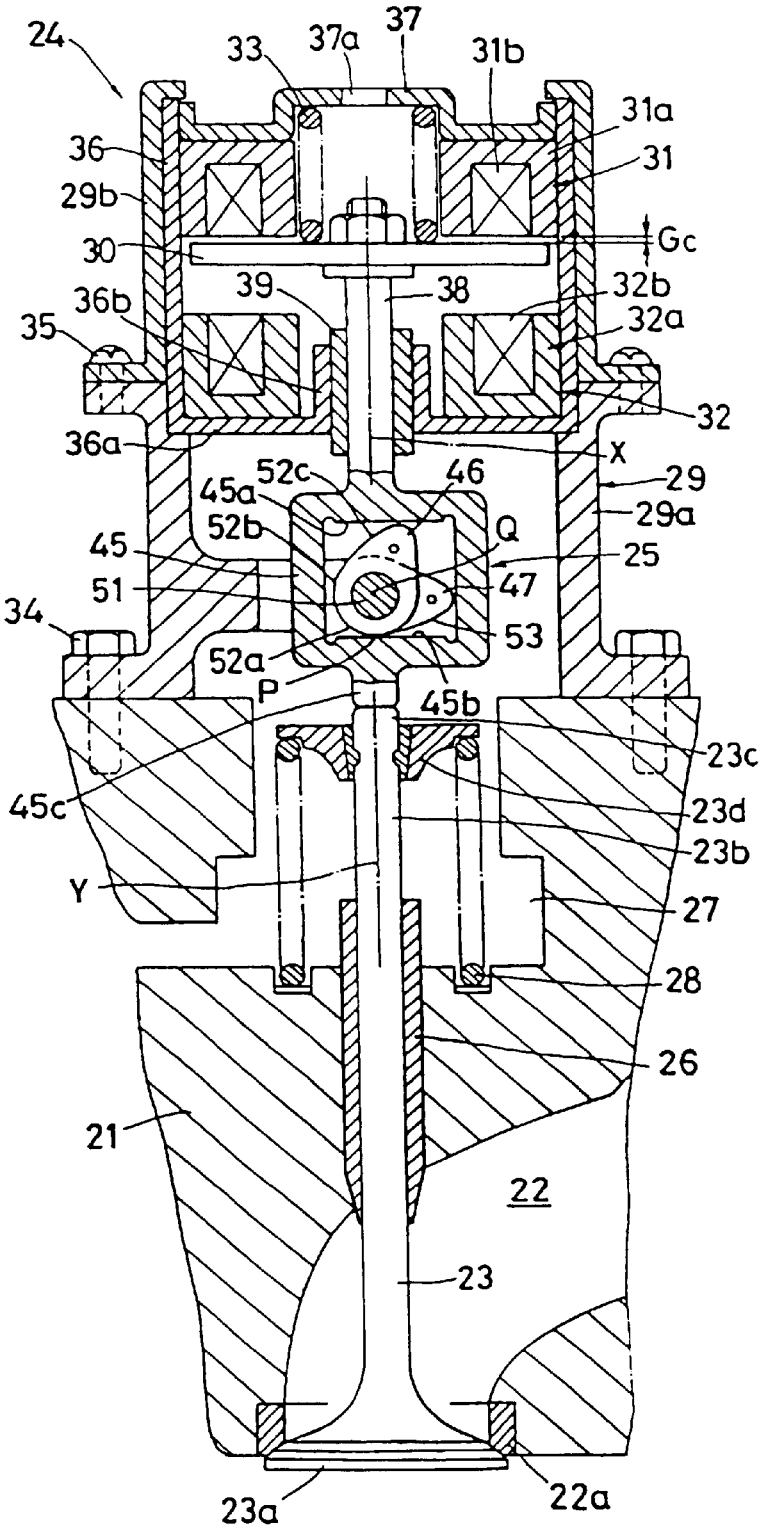
FIG. 6 is a vertical sectional drawing, showing a valve close state of the first embodiment of the present invention.

As illustrated in FIG. 2, each first and second swing cam 46, 47 is rotatably supported on a cam support shaft 51 that penetrates respective support holes 46*a*, 47*a* formed in the first and second swing cam 46, 47. Each end of the cam support shaft 51 is supported on a boss portion 50*a*, 50*b* of the casing 29 located an on opposite side of the first and second cams 46, 47. Namely, the first and second swing cam 46, 47 are supported coaxially on the cam support shaft 51 and adjacent to each other with slidable contact. Also, the axis Q of the cam support shaft 51 intersects with the axis X, Y of the guide rod 38 and the intake valve 23, respectively. Moreover, as shown in FIG. 3A and FIG. 3B, the first and second cams 46, 47 are shaped substantially like an egg in cross section, and a first cam surface 52 formed on entire upper surface of the first cam 46 rotatably contacts with the first follower surface 45*a*. Similarly, a second cam surface 53 formed on entire lower surface of the second swing cam 47 contacts with the second follower surface 45*b*. Each first and second cam surface 52, 53 has several cam profiles. The profiles include first and second base profiles 52*a*, 53*a* that are defined by a circle having a radius R0 centered on the axis Q of the cam support shaft 51, first and second ramp profiles 52*b*, 53*b* having gradually increased surfaces defined by radius of curvature R1 centered on the axis Q and being continuously connected with the base profiles 52*a*, 53*a*, respectively, and first and second lifting profiles 52*c*, 53*c* having lifting surfaces that are defined by radius of curvature R2 centered on the axis Q that are smaller than the radius of curvature R1 and are continuously connected with the first and second ramp profiles 52*b*, 53*b*, respectively. There also are the third and fourth ramp profiles 52*d*, 53*d* having gradually increased surfaces that are defined by radius of curvature R3 that are smaller than that of R1 and continuously connected with the first and second lifting profiles, respectively, and first and second nose profiles 52*e*, 53*e* having gradually increased surfaces defined by a radius R3 that are smaller than the radius of curvature R1 and are continuously connected with the first and second lifting profile 52*d*, 53*d*. As shown FIG. 4, each of the valve lift profile of the first and second swing cams 46, 47 with respected to rotation θ is designed with are S shape, and the first and second nose profile 52*e*, 53*e* are designed so as that a contacting distance between the first and second cam surfaces 52, 53 and the first and second surfaces of the follower 45*a*, 45*b* is relatively shorter. Therefore, the shorter contacting distance is possible to make the follower member 45 compact and able to contact with the first and second swing cams 46,47 smoothly when a vertical moving direction of the follower member 45 is changed. As illustrated in FIG. 5 and FIG. 6, first and second gaps Go, Gc are formed between the electromagnets 31, 32 and the armature 30 when the base profiles 52*a*, 53*a* of the swing cams 46, 47 are contacted with the respective follower surfaces 45*a*, 45*b* of the follower 45. As seen in FIG. 2, the first and second springs 48, 49 are wound around the cam support shaft 52, and each end of the springs 48*a*, 49*a* is retained in the respective boss portions 50*a*, 50*b*. The other end of the springs 48*b*, 49*b* are secured to the center portion of nose of the swing cams 46, 47, respectively. Thereby, each of the swing cams 46, 47 is urged resiliently against respective follower surfaces 45*a*, 45*b*.

The manner of operation of the first embodiment of the electromagnetic driving device in connection with the drawing will be explained.

First, when the engine is stopped, the first and second electromagnets 31, 32 are de-energized because no signals from electric control unit 40 is fed to the electromagnets 31, 32. Thereby, the armature 30 is positioned at a middle point of a gap S in balance between spring forces of the springs 28, 33. (See FIG. 1) Thus, the intake valve 23 is moved apart from the valve seat 22*a* and is lifted, indicating substantially a middle point between zero valve lift and maximum valve lift. In this state, each swing cam 46, 47 is exerted against the respective first and second follower surfaces 45*a*, 45*b* by the first and second springs 48, 49, as seen in FIG. 2.

Next, as seen in FIG. 5, when the engine is started, the electric controller 40 feeds the energized signals to the core 32*b* of the opening-electromagnet 32, and the armature 30 is attracted toward the opening-electromagnet 32 and is also urged downwardly by the armature spring 33. With this, the follower 45 is also moved downwardly by the guide rod 38 in accordance with the movement of the armature 30, and the protrusion 45*c* of the follower 45 pushes the intake valve 23 downwardly to open the intake port 22*y* against the valve spring 28.

On the other hand, when the intake valve 23 is operated in a closing state, the opening electromagnet 32 is de-energized, and the coil 31*b* of the closing electromagnet 31 is energized. (See FIG. 6)

Hence, the armature 30 is attracted to the closing-electromagnet 31 and is also urged upwardly by the valve spring 28. Thus, the intake valve 23 is moved upwardly against the spring force of the armature spring 33 and is seated against the valve seat 22*a* to close the intake port 22.

As a result, as the follower 45 is moved in a vertical direction, the first and second cam surface 52, 53 of the swing cams 46, 47 are swinging around the axis of the cam support shaft 51 and are contacted with respective the follower surface 45*a*, 45*b* against the spring force of the first and second springs 48, 49. Namely, as shown in FIG. 7A, the first and second swing cams 46, 47 are moving in a clockwise or counterclockwise direction, so that the swing cams 46, 47 make the intake valve 23 open and close smoothly at the end period of the movement thereof As mentioned above, when the intake valve 23 is moved upwardly by attracting force of the closing-electromagnet 31 and the spring force of the valve spring 28, a contacting point P between the second cam surface 53 and the second follower surface 45*b* is moved from the second lifting profile 53*d* to the base profile 53*a*. (See FIG. 5 and FIG. 6) Namely, when the intake valve closes the intake port 22, as shown FIG. 7, the second spring 49 urges the follower 45 downwardly in the opposite direction of the movement of the intake valve 23, and brakes the movement of the intake valve 23 at the end period of valve closing operation. That is, the braking function affects the movement of the armature 30 and the intake valve 23 and decreases the speeds of the movement of the armature 30 and the intake valve 23 through the second swing cam 47 and the second follower surface 45*b* during the end period of the closing stroke of the intake valve 23. After that, the base profile 53*a* of the second swing cam surface 53 is contacted with the second follower surface 45*b*, so that the intake valve 23 is seated against the valve seat 22*a* gently and smoothly.

Similarly, the braking function (buffering function) affects the armature 30 and the intake valve 23 at the end period of the opening valve operation. In this situation, the contacting point P between the first swing cam 46 and the first follower surface 45*a* is moved from the lifting profile 52*d* to the base profile 52*a*, so that the first spring 48 urges the follower member 45 toward the opposite direction of the movement of the armature 30. Therefore, the armature 30 is prevented from colliding with the opening-electromagnet 32, and the intake valve 23 exhibits an ideal valve lift characteristic at the end period of the opening stroke thereof In brief, a turning moment on the follower 45 produced by swinging of respective first and second cams 46, 47 performs a braking function at the end period of the opening and closing valve lift, so that a buffering effect is provided on the intake valve 23.

As mention above, a resultant spring force of valve spring 28, armature spring 33, and respective first and second springs 48, 49 acting on the armature 30 increases suddenly where the armature 30 is at upper and lower positions of the gap S between the electromagnets 31, 32. Namely, as shown in FIG. 7B, the sudden increase of resultant spring force performs as the braking function at the end period of opening and closing valve lift.

Thereby, as seen in FIG. 7A, especially in areas as shown by dotted-line circle of FIG. 7A, the intake valve 23 is capable of seating against the valve seat 22*a* smoothly and gently. Therefore, this invention makes it possible to prevent noise, wear and damage caused by the collision between the intake valve 23 and the valve seat 22*a* and between the armature 30 and the opening electromagnet 32.

In addition, as illustrated in FIG. 5 and FIG. 6, since the gaps Go, Gc are formed between the upper and lower surfaces of the armature 30 and the respective closing and opening-electromagnets 31, 32 at the uppermost and the lowermost position of the armature 30, this invention makes it possible to prevent the collisions between the armature 30 and respective closing and opening electromagnets 31, 32.

Moreover, since the electromagnetic driving mechanism 24 is disposed separately from the intake valve 23, the intake valve 23 is capable of seating the valve seat 22*a* tightly, even if a gap exists between the protrusion 38*b* and the end of the stem 23*c*. Therefore, the intake valve 23 seats the valve seat 22*a* stably and tightly.

Further, the intake valve 23 and the valve spring 28 are arranged in the conventional way. Therefore, the electromagnetic driving mechanism 24 and the braking mechanism 25 can be assembled in advance and installed on the cylinder head 21 easily.

Also, in the first embodiment of the present invention, since each of the first and second swing cams 46, 47 is exerted toward respective first and second cam surfaces 45*a*, 45*b* by the first and second spring 48, 49, respectively, it is not necessary to manage respective clearances between the first and second follower surfaces 45*a*, 45*b* and the first and second cam surfaces 52, 53. As mentioned above, the first embodiment doesn't require a close tolerance to manufacture the swing cams 46, 47 and the follower 45 so that the cost of manufacturing can be reduced.

Moreover, since the swing cams 46, 47 are manufactured and designed with their cam profiles separately, the armature 30 can obtain an appropriate buffering effect at the uppermost and lowermost positions thereof.

Further, if wear is occurs between the first and second cams 52, 53 and respective first and second follower surfaces 45*a* and 45*b*, the first and second cams 52, 53 are always urged and contacted with respective follower surfaces 45*a*, 45*b* by the first and second spring 48, 49. With this, the braking function and the buffering effect are never decreased due to wear.

Moreover, the guide rod 38 is prevented from leaning effectively where the axis Q of the cam support shaft 51 intersects with either the axis X of the guide rod 38 or the axis Y of the valve stem 23.

Also, in the first embodiment, the follower 45 may be formed to be symmetric with respect to the axis X of the guide rod 38. In this case, it is not only possible to make it compact, but it is not necessary to consider an aspect of the follower 38 when it is assembled.

Figure 8:
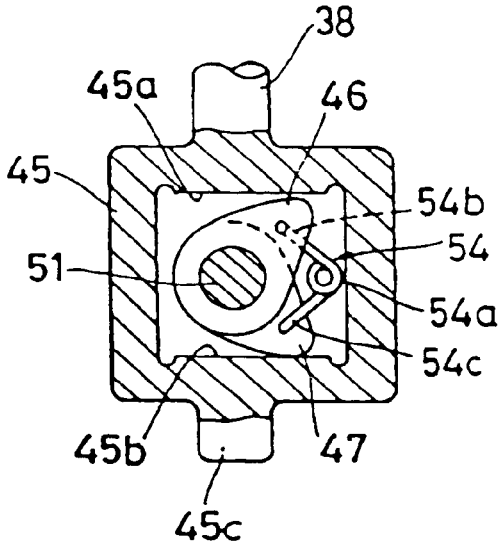
FIG. 8 is a fragmentary sectional drawing, showing a cam of an electromagnetic driving device in accordance with a second embodiment of the present invention.
Figure 9:
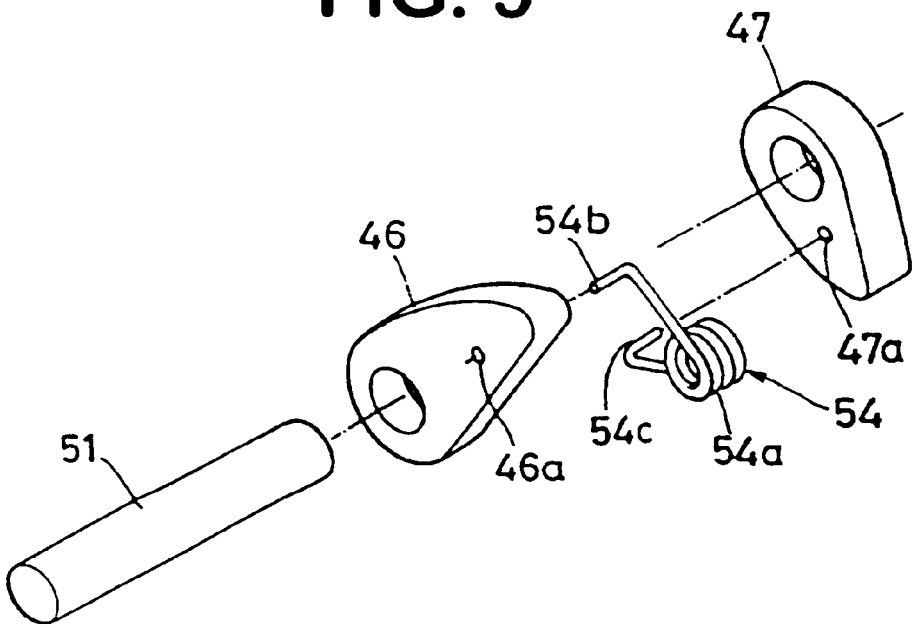
FIG. 9 is a perspective view, showing a cam in accordance with the second embodiment of the present invention.

Next, since the electromagnetic driving device is identical to the first embodiment, like elements are given like reference characters. FIG. 8 and FIG. 9 are similar to the first embodiment with the exception that it provides a braking mechanism 25 having an torsion coil spring 54 that urges both of the first and second cams 46, 47 toward the follower surfaces 45*a*, 45*b*.

Namely, the torsion coil spring 54 is interposed between the first and second cams 46, 47, and one of the ends of the torsion coil spring 54*b* is inserted into a first holding hole 46*a* that is formed on a side surface of the first cam 46, and the other end of the torsion coil spring 54*c* is inserted in the second holding hole 47*a* that is formed on a side surface of the second cam 47. Thereby, the torsion coil spring 54 exerts a force on the first and second cams 46, 47 in opposite directions so as that the first and second cam surfaces 52, 53 are resiliently urged to the first and second follower surface 45*a*, 45*b*. With the second embodiment, the cost of manufacturing and a saving space can be further lowered in comparison with the foregoing first embodiment, which achieving substantially an equivalent effect to the first embodiment.

Figure 10:
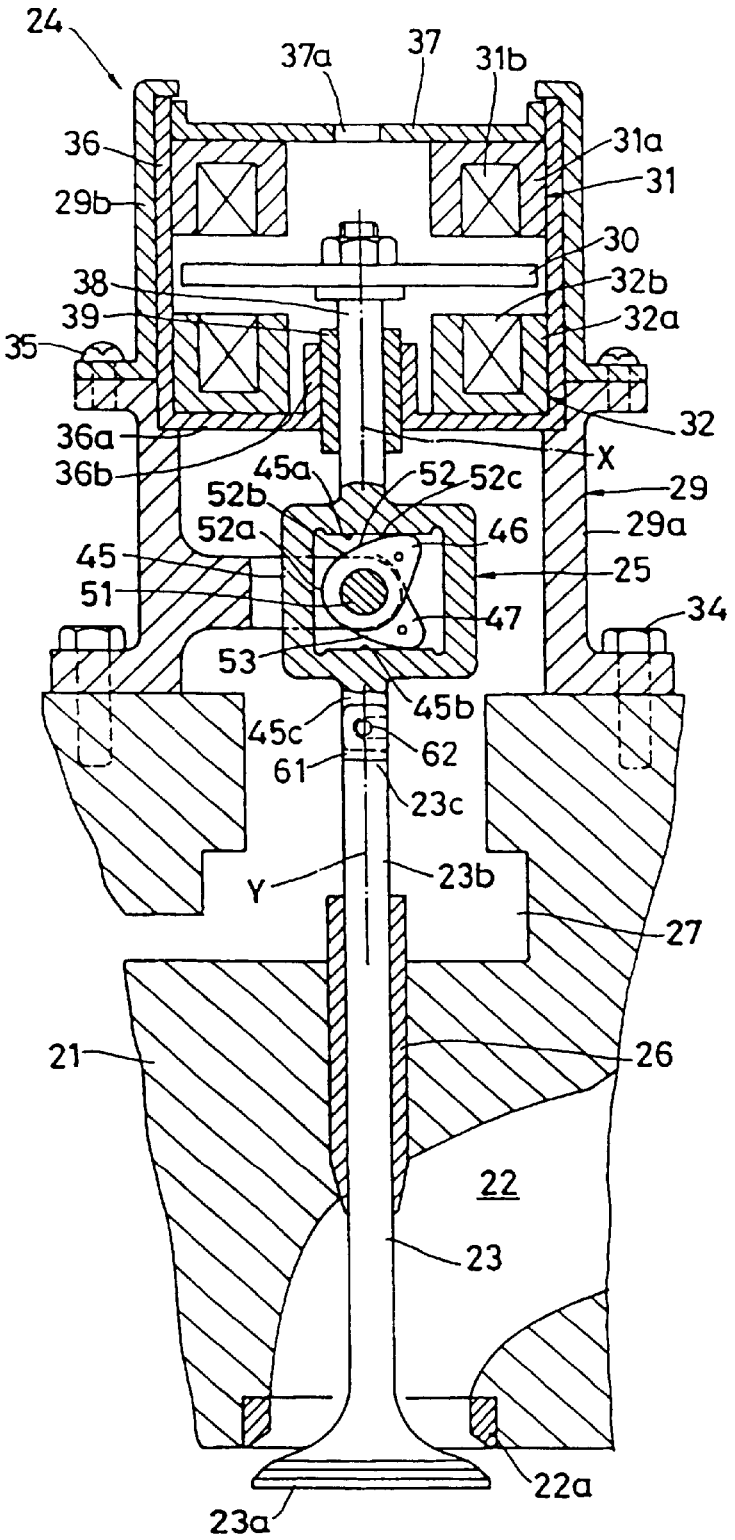
FIG. 10 is a vertical sectional view, showing an electromagnetic driving device of a third embodiment of the present invention.
Figure 11:
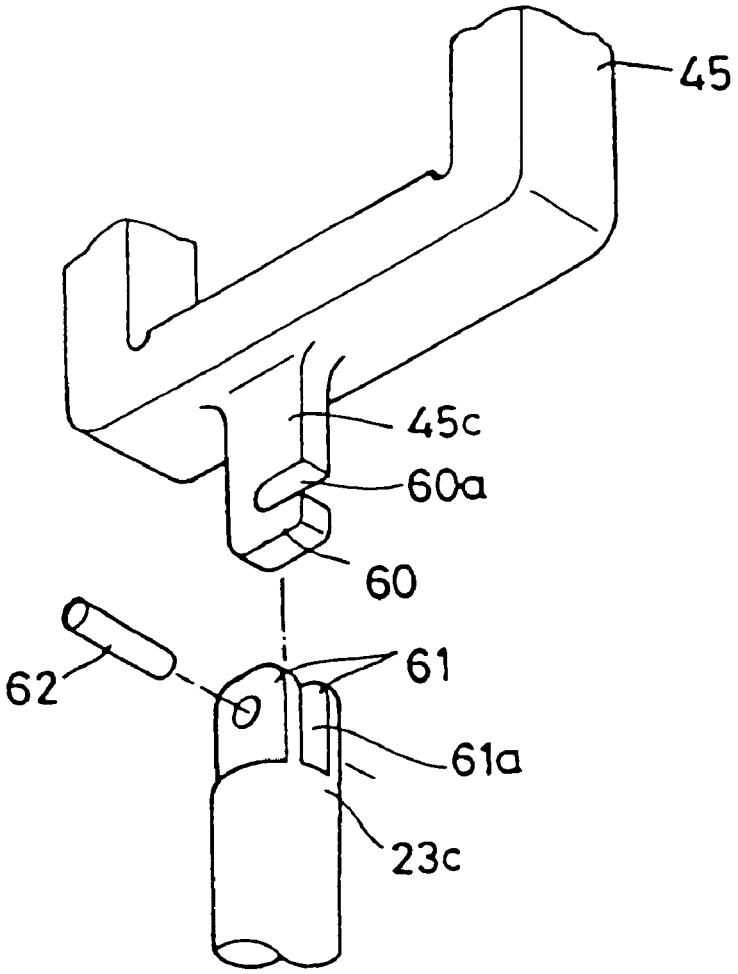
FIG. 11 is a perspective view, showing a linkage between an end of valve and a follower of the third embodiment of the present invention.
Figure 12:
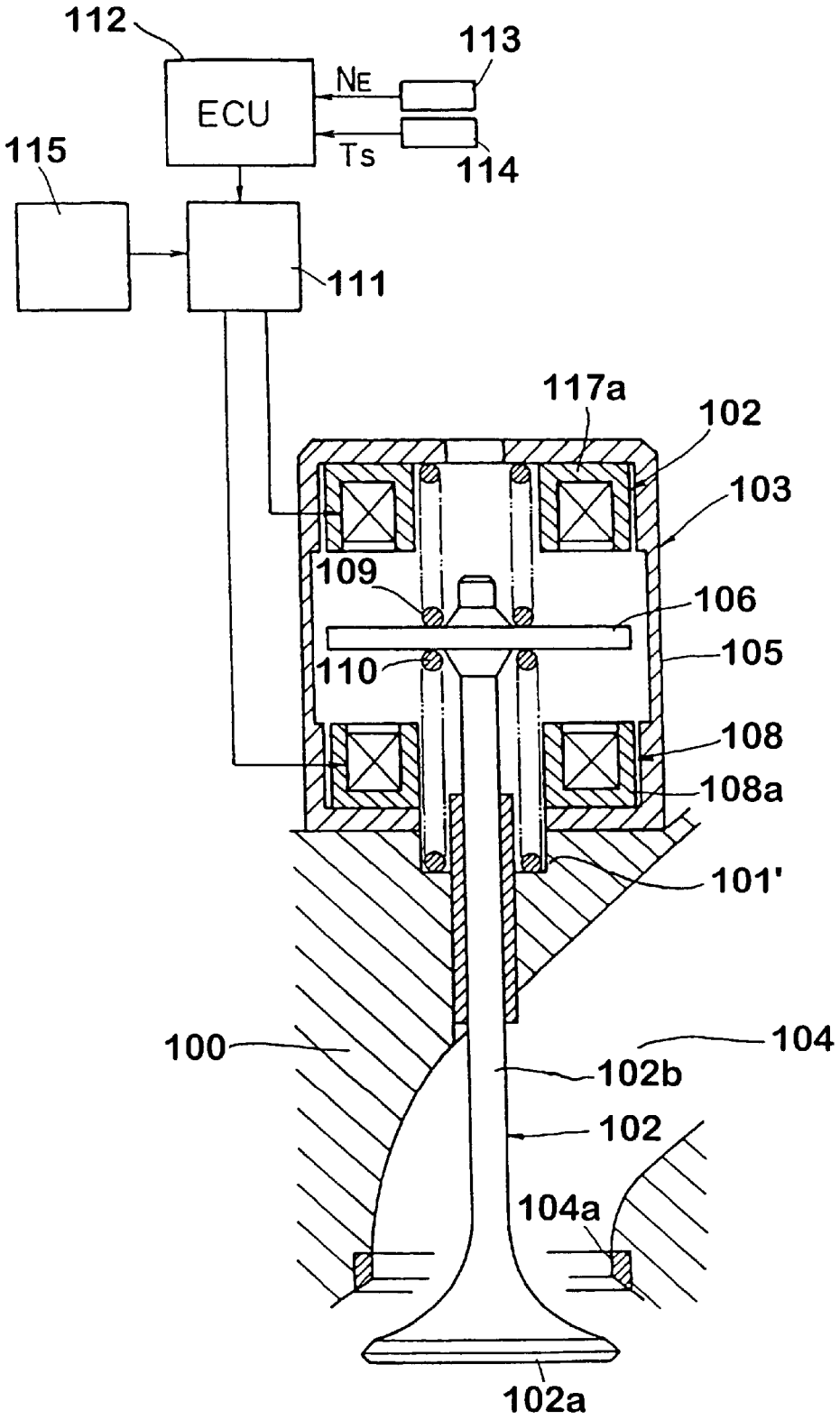
FIG. 12 PRIOR ART
FIG. 12 is a vertical sectional view, showing a conventional electromagnetic driving device.
Figures 13A, 13B:
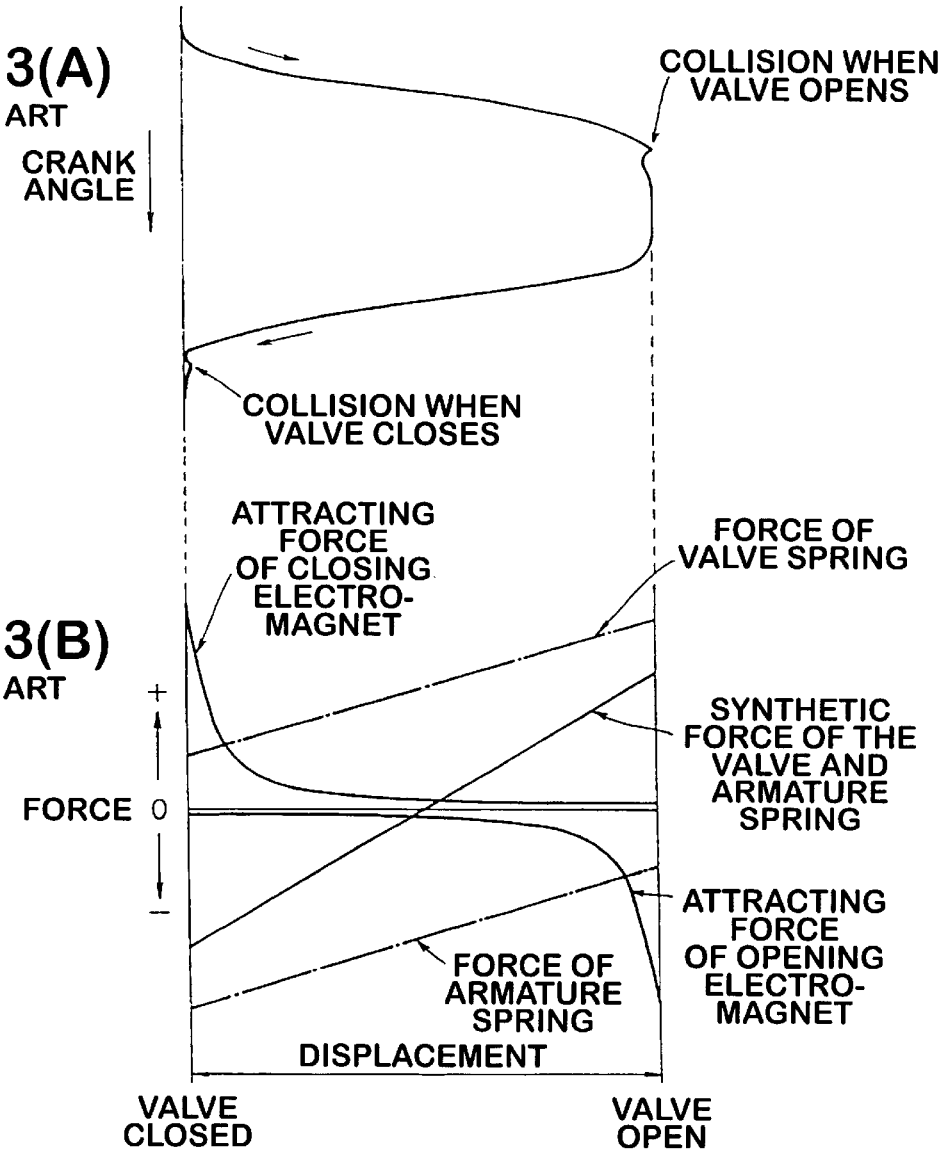
FIG. 13(A) PRIOR ART
FIG. 13(B) PRIOR ART
FIG. 13A is a graph, showing the timing of an intake valve opening and closing an intake port of a cylinder head in accordance with a prior art.
FIG. 13B is a graph, showing a characteristic of a attracting force of respective electromagnets and a spring force of respective springs.

FIG. 10 and FIG. 11 shows a third embodiment of the present invention, and a lower end protrusion 45*c* of the follower 45 is linked with the valve stem 23 by means of a mechanical linkage having a hook formed in the lower end of the follower 45, a cut-out groove 61 formed at the stem end 23 and provided with a pin hole, and a pin 62 inserted through the pin hole and the cut-out groove 61. The third embodiment also can decommission the armature spring 33 and the valve spring 28 that are used in foregoing embodiment. As shown in FIG. 11, the hook 60 is provided with a groove 60*a* extending in the lateral direction that engages with the cut-out groove 61 extending in longitudinal direction and shaped like a fork through the pin 62. In addition, the spring forces of the first and second springs 48, 49 are designed to be larger than that of the first and second embodiment, so as to make the intake valve 23 positioned at middle of valve lift stroke, which achieving the same effect to the armature spring 33 and the valve spring 28.

Therefore, since the armature spring 33 and the valve spring 28 are removed from the service, the third embodiment is simple and easily assembled.

The present embodiments are to be considered as illustrative and not restrictive and the invention is not to be limited to the details given herein, but may be modified within the scope and equivalence of the appended claims.

For example, while the embodiment of the invention shows that the intake valve 23 is subject to the electromagnetic driving device, an exhaust valve also may be controlled. In this case, the exhaust valve is capable of controlling the valve movement smoothly and gently at the end of term of the closing a exhaust, so that it reduce a noise of a exhaust gas.

The entire contents of basic Japanese Patent Application, application No. 11-126811, filed May 7, 1999 of the application of which priority are claimed, are herein incorporated by reference.

What is claimed is:

1. An electromagnetic device for driving an engine valve in an internal combustion engine, the valve comprising a stem defining along its longitudinal dimension a movement axis and having at one end thereof a valve portion that engages a valve seat for closing and opening an exhaust passage, comprising:

an armature mechanically coupled to the valve stem;

an electromagnetic driving mechanism comprises first and second electromagnets, disposed on opposite sides of the armature and being separately operable to magnetically engage the armature;

a follower member, having first and second follower surfaces that are opposite to each other disposed along the movement axis and being coupled with the valve stem and the armature;

first and second cams having gradually varied profiles and being pivoted for contacting, respectively, the first and second follower surfaces;

first and second springs operative to urge the first and second cams toward the first and second follower surfaces, respectively; and a controller operative to selectively energize the electromagnets in accordance with an engine condition for controlling a movement of the armature.

2. The electromagnetic device for driving an engine valve as set forth in claim 1, wherein the follower member is disposed between the valve stem and the armature.

3. The electromagnetic device for driving an engine valve as set forth in claim 2, wherein the first and second cams are rotatable on a common pivot axis and each cam includes a base profile, a lift profile, and a nose profile;

wherein the base profile is defined by first radius centered on the common pivot axis and defines a non valve lifting range;

wherein the lift profile is defined by gradually increased radii centered on the common pivot axis and is continuously connected with the base profile; and wherein the nose profile is defined by a second radius that is smaller than the first radius and is continuously connected with the lift profile.

4. The electromagnetic device for driving an engine valve as set forth in claim 3, wherein the nose profile of the first cam is in contact with the first follower surface when the valve lift is a zero lift.

5. The electromagnetic device for driving an engine valve as set forth in claim 3 wherein a first gap is formed between the armature and the first electromagnet when the nose profile of the first cam is in contact with the first follower surface.

6. The electromagnetic device for driving an engine valve as set forth in claim 5, wherein the nose profile of the second cam is in contacted with second follower surface, when the valve lift is a maximum lift.

7. The electromagnetic device for driving an engine valve as set forth in claim 5 wherein a second gap is formed between the armature and the second electromagnet when the nose profile of the second cam is in contact with the second follower surface.

8. The electromagnetic device for driving an engine valve as set forth in claim 1, wherein the common pivot axis of the first and second cams intersects with the movement axis of the valve.

9. The electromagnetic device for driving an engine valve as set forth in claim 8, wherein the follower member is coupled with the armature through a guide rod, the guide rod having an axis in the movement axis direction; and wherein the axis of the guide rod intersects with the common pivot axis of the first and second cams.

10. The electromagnetic device for driving an engine valve as set forth in claim 9, further comprising:

a support shaft disposed on a casing that is integrated with a cylinder head; and wherein the first and second cams are coaxially supported on the support shaft.

11. The electromagnetic device for driving an engine valve as set forth in claim 1, wherein the follower member is shaped like a rectangle in cross section; and wherein the first and second cams are encased in the follower member.

12. The electromagnetic device for driving an engine valve as set forth in claim 11, wherein the first and second springs are operatively connected between a casing disposed on a cylinder head and the first and second cams, respectively.

13. The electromagnetic device for driving an engine valve as set forth in claim 11, wherein the first and second spring are interposed between the first and second cams and the support shaft, respectively, for urging the first and second cams away from each other so as to contact respective the first and second follower surfaces.

14. The electromagnetic device for driving an engine valve as set forth in claim 11, further comprising:

an opening formed on an end of the valve stem;

a pivotal pin extending through the opening; and wherein the follower member having a connecting hole is linked with the end of the valve through the pivotal pin.

15. An electromagnetic device for driving an engine valve in an internal combustion engine, the valve comprising a stem defining along its longitudinal dimension a movement axis and having at one end thereof a valve portion that engages a valve seat for closing and opening an exhaust passage, comprising:

an armature mechanically coupled to the valve stem;

an electromagnetic driving mechanism comprises first and second electromagnets encased in a casing that is integral with a cylinder head and disposed on opposite sides of an armature and being separately operable to magnetically engage the armature;

a follower member, having first and second follower surfaces that are opposite to each other disposed along the movement axis and being coupled with the valve stem and the armature;

an armature spring interposed between the armature and the casing for urging the armature to open the valve;

a valve spring disposed between the valve and the cylinder head for urging the valve to close;

first and second cams having gradually varied profiles and being pivoted for contacting, respectively, the first and second follower surfaces;

first and second springs operative to urge the first and second cams toward the first and second follower surfaces, respectively; and a controller operative to selectively energize the electromagnets in accordance with an engine condition for controlling a movement of the armature.

16. The electromagnetic device for driving an engine valve as set forth in claim 15, wherein the first and second cams are rotatable on a common pivot axis and each cam includes a base profile, a lift profile, and a nose profile;

wherein the base profile is defined by first radius centered on the pivot and defines a non valve lifting range;

wherein the lift profile is defined by gradually increased radii centered on the common pivot axis and is continuously connected with the base profile;

wherein the nose profile is defined by a second radius that is smaller than the first radius and is continuously connected with the lift profile; and wherein the base profile of the first cam is in contact with the first follower surface and the nose profile of the second cam is in contact with the second follower surface when the valve lift is maximum lift.

17. The electromagnetic driving device for the engine valve as set forth in claim 18, wherein the nose profile of the first cam is in contact with the first follower surface and the base profile of the second cam is in contact with the second follower surface when the valve lift is a zero lift.

18. The electromagnetic driving device for the engine valve as set forth in claim 16, wherein the base contacting points bet ween the first and second follower surfaces and the base profiles of the first and second cams are closer to the movement axis of the valve axis than the nose contacting points between the first and second followers and the nose profile of the first and second cams.

19. The electromagnetic driving device for the engine as set forth claim 16, wherein the midpoints of the first and second follower surfaces are offset from the movement axis of the valve.

* * * * *